US006464570B1

(12) United States Patent
Shaw et al.

(10) Patent No.: US 6,464,570 B1
(45) Date of Patent: Oct. 15, 2002

(54) OMNIDIRECTIONAL SHOT NOZZLE

(75) Inventors: James Stephen Shaw, Hampton Falls, NH (US); Mark Joseph Rechtsteiner, Cincinnati, OH (US); William Douglas Rouse, Milford, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/906,976

(22) Filed: Jul. 17, 2001

(51) Int. Cl.[7] ..... B24C 5/04
(52) U.S. Cl. ..... 451/102; 451/38; 451/90
(58) Field of Search ..... 451/102, 38, 39, 451/90, 75; 239/3, 116, 122, 336, 697

(56) References Cited

U.S. PATENT DOCUMENTS 4,634,058 A * 1/1987 Hollstein et al. ..... 239/697
5,622,313 A * 4/1997 Lader et al. ..... 239/3
5,850,976 A * 12/1998 Robidoux ..... 239/698
6,183,347 B1 2/2001 Shaw

* cited by examiner

*Primary Examiner*—Timothy V. Eley
*Assistant Examiner*—Dung Van Nguyen
(74) *Attorney, Agent, or Firm*—V. G. Ramaswamy; Francis L. Conte

(57) ABSTRACT

A nozzle includes a tube and a flared deflector extending coaxially from an outlet thereof. A stream of abrasive pliant shot is discharged through the nozzle and deflected radially outwardly from the deflector for abrading a shifting edge along an aperture in a workpiece surface.

19 Claims, 4 Drawing Sheets

OMNIDIRECTIONAL SHOT NOZZLE

BACKGROUND OF THE INVENTION

The present invention relates generally to manufacture and repair of machine parts, and, more specifically, to surface finishing of such parts.

Machines are assemblies of various parts which are individually manufactured and assembled. Machines typically include metal parts, although synthetic and composite parts may also be used. And, each part requires specialized manufacturing.

For example, metal parts may be fabricated from metal stock in the form of sheets, plates, bars, and rods. Metal parts may also be formed by casting or forging. Such parts may be machined to shape in various manners.

Machining requires the selective removal of material to configure the part to its final shape and size within suitable manufacturing tolerances, typically expressed in mils, and with a suitable surface finish which is typically smooth or polished without blemish.

Each step in the manufacturing process of machine parts adds time and expense which should be minimized for producing a competitively priced product. It is desirable for each subsequent step in the manufacturing process to avoid damaging previously finished portions of the part which would then require additional corrective finishing steps.

Gas turbine engines are an example of a complex machine having many parts requiring precise manufacturing tolerances and fine surface finishes. A typical engine includes a multistage compressor for pressurizing air which is mixed with fuel in a combustor and ignited for generating hot combustion gases which flow downstream through one or more turbine stages that extract energy therefrom. A high pressure turbine powers the compressor, and a low pressure turbine provides output power, such as powering a fan disposed upstream from the compressor in an aircraft engine application.

The engine thusly includes various stationary components, and various rotating components which are typically formed of high strength, state of the art metal and composite materials. The various parts undergo several steps in their manufacturing and are relatively expensive to produce.

Of particular interest in manufacturing compressor and turbine rotor disks is maintaining smooth surface finish thereof and large radii along edges therein for minimizing stress during operation. Rotor disks support corresponding rotor blades around the perimeters thereof, and are subject to substantial centrifugal force during operation. The centrifugal force generates stress in the rotor disk which can be concentrated at sharp edges or small comers in the disk, which must therefore be suitably eliminated.

In one type of rotor disk, axial dovetail slots are formed through the perimeter of the disk for retaining rotor blades having corresponding axial dovetails. The dovetails include one or more pairs of dovetail tangs, in the exemplary form of a fir tree, which mate in complementary dovetail slots formed between corresponding disk posts.

The dovetail slots are typically manufactured by broaching wherein successively larger cutting tools cut the perimeter of the rotor disk to form the desired dovetail slots in a sequential operation. Each dovetail slot is broached in turn until the full complement of slots is formed around the perimeter of the disk.

The disk prior to the broaching operation has already undergone several steps in the manufacturing process including precision machining of most of its external surface. Broaching of the dovetail slots in the perimeter of the disk typically results in sharp comers or edges on the entrance side of the slot, and burrs on the exit side of the slot. The sharp entrance edges and burred exit edges require further processing to form suitably large radii which correspondingly reduce stress concentrations during operation of the rotor disk.

Deburring and radiusing of the rotor disk typically requires several additional processes in view of the complexity of the rotor disk and the complexity of the dovetail slots therein. For example, the individual rotor disk after broaching may be turned inside a bed of abrasive particles, such as the Sutton Blend (trademark) process, used to initially deburr the slots and form suitable comer radii therealong. However, the Sutton Blend process is directional and is effective for radiusing only some of the edges of the serpentine dovetail slots.

Accordingly, the disk undergoes additional processing for benching or further abrading slot edges, typically near their bases, by hand or robotically. One form of benching is conventionally known as Harperizing which is a trademark process using cloth wheels having abrasive therein.

This process is then followed by a conventional abrasive flow for blending the benched regions as required for achieving suitable radii.

These various steps require corresponding processing time, and are correspondingly expensive. And, hand benching always includes the risk of inadvertent damage to the rotor disk rendering it defective, and requiring scrapping thereof at considerable expense.

Furthermore, the rotor disk includes other machined features which may have sharp edges and burrs thereon which also require processing. For example, an annular row of axial holes extend through the web of the disk below the dovetail slots which receive retaining bolts during assembly. These bolt holes are suitably drilled, and like broaching, have sharp entrances and sharp exits with burrs thereon. These edges are also suitably radiused using the processes described above, which adds to the time and expense for disk manufacture.

The deburring and radiusing processes described above are used selectively for the edges being treated to avoid or minimize any changes to the remaining surface of the rotor disk which is typically smooth with a fine surface finish. Any damage to that finish requires additional processing and corresponding time and expense.

A new process for deburring and radiusing these edges is disclosed in U.S. patent application Ser. No. 09/358,643, now U.S. Pat. No. 6,273,788, and entitled Sustained Surface Scrubbing. This scrubbing process uses pliant abrasive shot discharged at a shallow angle of incidence to the workpiece surface substantially normal or perpendicular to the edge being treated. The shallow incidence angle protects the surface, while impingement of the shot against the protruding edges is effective for deburring and radiusing thereof.

U.S. Pat. No. 6,183,347, entitled Sustained Surface Step Scrubbing, discloses a process in which the disk holes and dovetail slots are partially filled with plugs for locally deburring and radiusing the shifting edges thereof.

And, U.S. patent application Ser. No. 09/379,918, entitled Shifting Edge Scrubbing, discloses a process in which the rotor disk is mounted on a rotating platter which in turn revolves atop another platter for providing compound motion to deburr and radius the serpentine edges of the dovetail slots and the circular edges of the bolt holes.

Since the edges of the various forms of apertures shift in profile, the relative position between those edges and the discharged shot stream must be controlled for obtaining both the shallow angle of incidence with the flat surface being protected, and the substantially normal angle of impingement against the protruding edges for locally and selectively deburring and radiusing thereof. Accordingly, either the nozzle or the workpiece, or both, may be moved for ensuring that all of the shifting edges of the various rows of holes or dovetail slots are suitably scrubbed during the scrubbing process.

In a further development of this process, some workpieces have protruding portions which prevent unobstructed access to all of the apertures for scrubbing. For example, the rotor disk may include an integral tubular shaft projecting from either or both sides thereof radially inwardly of the dovetail slots or mounting bolt holes. The shaft interferes with the placement of an inclined nozzle for achieving the desired angular orientation thereof for scrubbing the entire perimeter of the shifting edges.

Accordingly, it is desired to provide an improved apparatus and process for scrubbing shifting edges without interference with adjacent workpiece protrusions.

BRIEF SUMMARY OF THE INVENTION

A nozzle includes a tube and a flared deflector extending coaxially from an outlet thereof. A stream of abrasive pliant shot is discharged through the nozzle and deflected radially outwardly from the deflector for abrading a shifting edge along an aperture in a workpiece surface.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
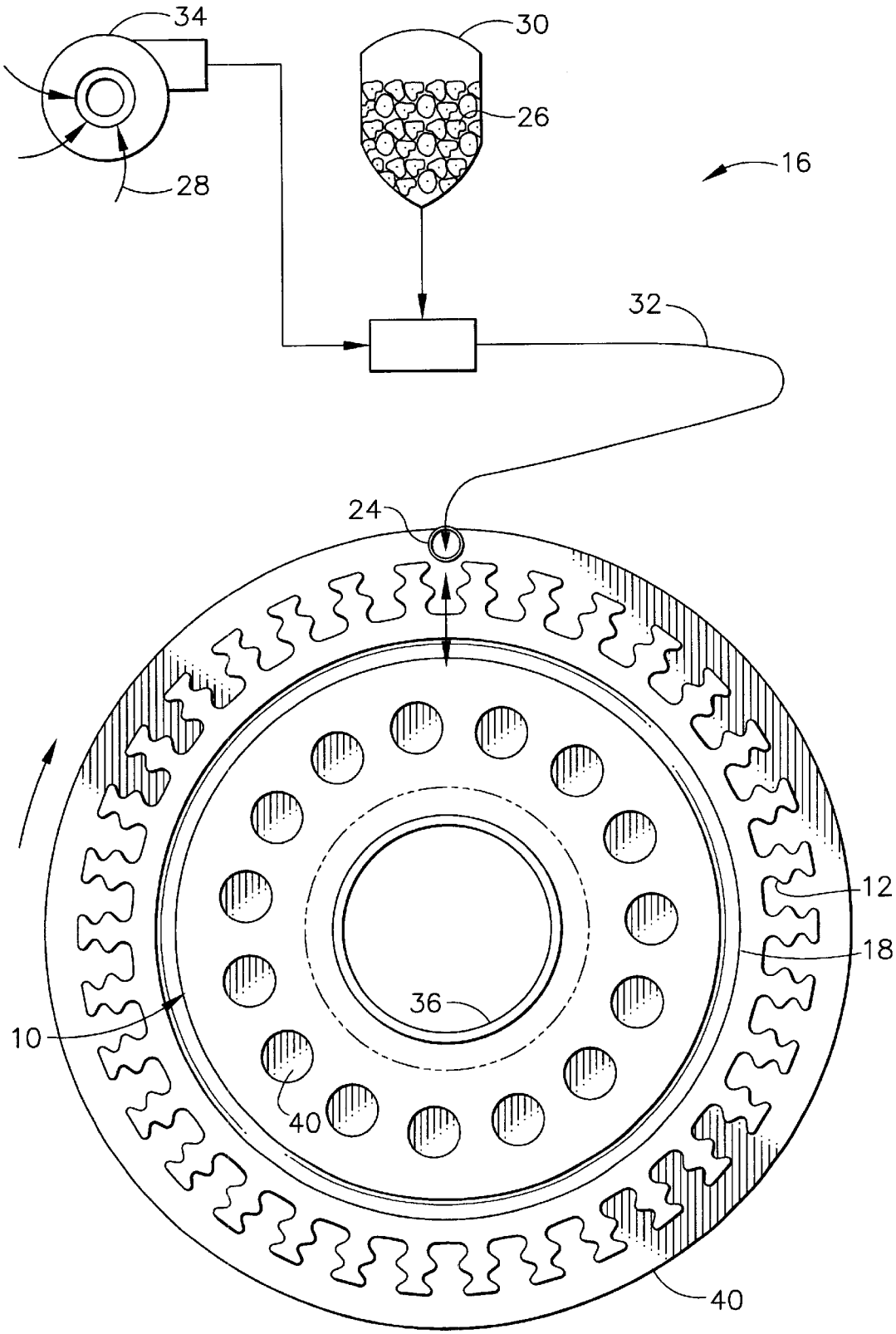
FIG. 1 is a schematic representation of an apparatus including an omnidirectional nozzle for discharging a stream of abrasive pliant shot for scrubbing a workpiece in accordance with an exemplary embodiment of the present invention.

Illustrated in FIG. 1 is workpiece 10 in the exemplary form of a gas turbine engine rotor disk as may be found in a turbine or compressor thereof. The workpiece is formed of metal, although other workpieces of different configurations may be used and formed of different materials as desired.

Figure 2:
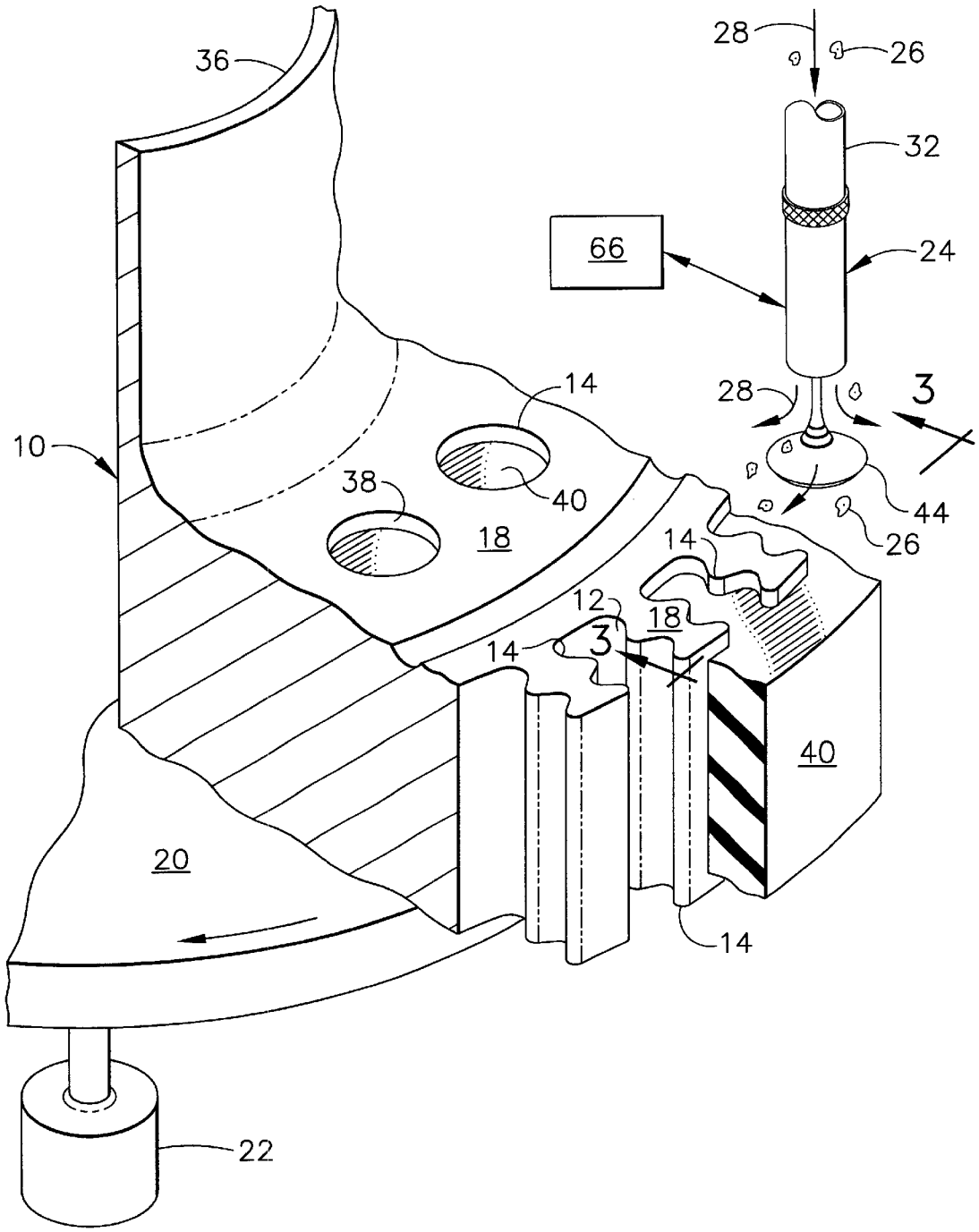
FIG. 2 is a partly schematic isometric elevational view of a portion of the workpiece rotor disk illustrated in FIG. 1 being scrubbed by pliant shot discharged from the nozzle.

As illustrated in more detail in FIG. 2, the disk may have any conventional form including a plurality of circumferentially spaced apart dovetail apertures or slots 12 extending axially through the perimeter thereof. The dovetail slots are typically formed by broaching in which a series of increasingly sized cutters are drawn across the perimeter of an initially solid rotor disk to form the respective dovetail slots therein.

Figure 3:
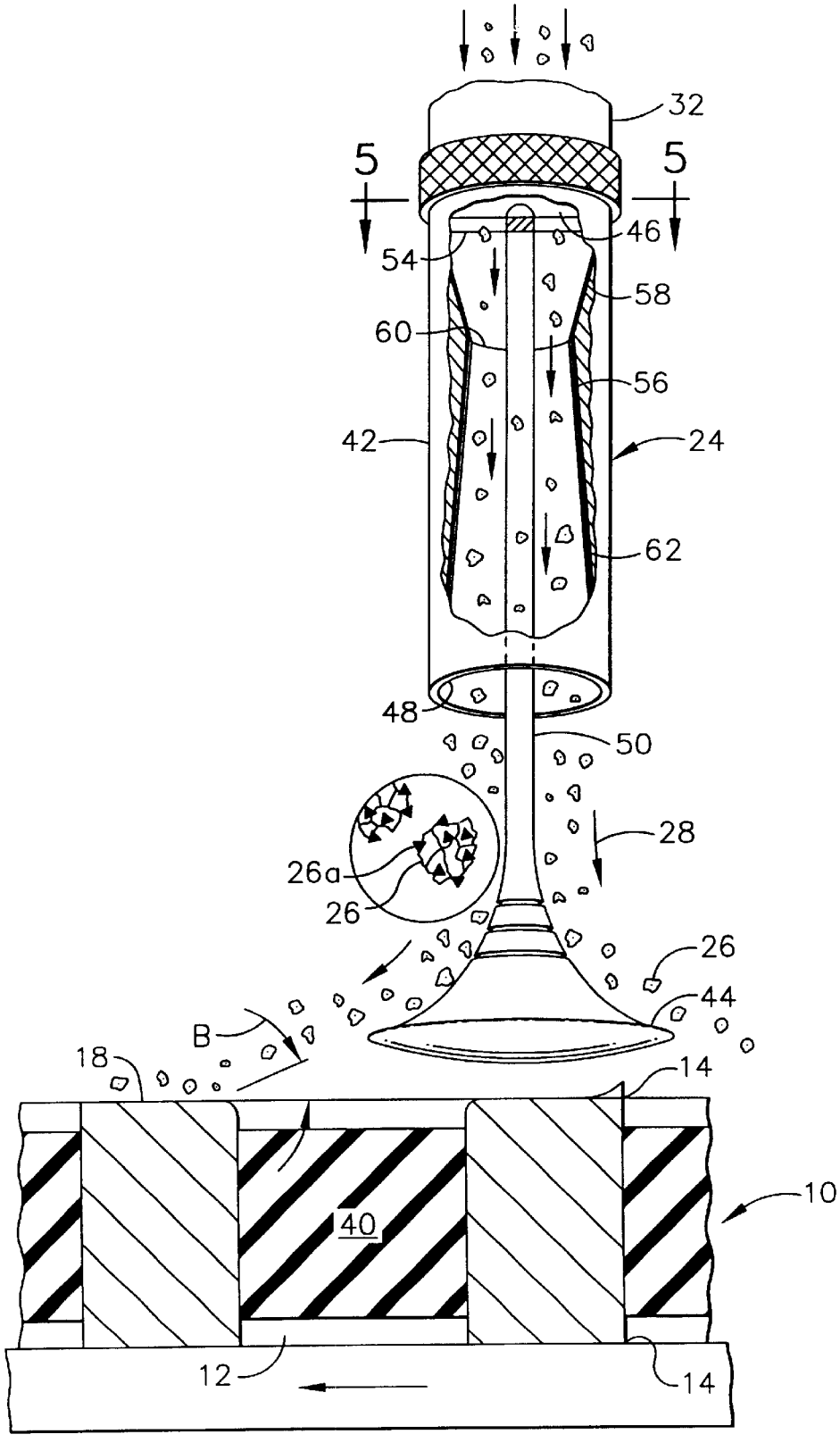
FIG. 3 is a partly sectional elevational view of the nozzle and portion of the workpiece illustrated in FIG. 2, and taken generally along line 3—3.

As a result of broaching, each of the dovetail slots initially has sharp edges 14, as shown in more detail in FIG. 3, at both its entrance side and exit side. The exit side of the broached dovetail slot typically also includes sharp burrs extending outwardly therefrom.

As indicated above, the rotor disk has undergone various manufacturing steps prior to broaching, and has precise dimensions and a smooth surface finish which must be protected in subsequent operations. Deburring of the broached dovetail slots is required, and the dovetail edges are typically radiused for reducing stress concentration thereat. However, deburring and radiusing typically requires multiple additional processing steps in conventional practice in view of the shifting or meandering profile of the individual dovetail slots as illustrated in FIG. 2.

Each dovetail slot is in the form of a fir tree defined between pairs of lobes or tangs in dovetail posts remaining in the disk perimeter after the broaching operation. The entrance and exit edges 14 of each dovetail slot continually shift in direction from the outer perimeter of the disk to the bases of the slots and back to the outer perimeter of the disk to correspond with the desired profile of the dovetail slots. In this way, complementary dovetails of rotor blades (not shown) are radially retained in the corresponding slots by the cooperating pressure faces defined between the dovetails and their disk slots.

The shifting profile of the individual dovetail slots increases the complexity of deburring thereof and radiusing thereof by conventional processes which are directional or subject to variation if done by hand.

Illustrated initially in FIG. 1 is an apparatus 16 specifically configured for treating a workpiece in the exemplary form of the rotor disk 10 which has one or more apertures 12 requiring deburring or radiusing thereof along the corresponding edges. The disk 10 has two axially opposite side surfaces 18 through which the disk slots 12 extend. The disk surfaces 18 are typically premachined to a precise and smooth finish which is protected during abrasion of the dovetail slot edges.

The apparatus 16 illustrated in FIGS. 1 and 2 includes a rotary platter or turntable 20 for supporting the disk thereatop, and is rotated during operation by a suitable motor 22. A nozzle 24 is provided for discharging a stream of pliant or soft abrasive shot 26 in a carrier fluid 28, such as air, atop the disk for edge treatment thereof.

The shot blasting apparatus illustrated in FIG. 1 includes a hopper 30 in which the pliant shot is stored. The hopper is joined in flow communication with the nozzle 24 by a delivery hose or conduit 32 through which the shot is channeled.

An air compressor or pump 34 is operatively joined to the hose 32 for providing air as the carrier fluid under suitable pressure for carrying and discharging the shot in a stream through the nozzle. A suitable mixing valve or device joins together the discharge ends of the hopper 30 and the compressor 34 for mixing the shot in the air for discharge through the hose. Relatively low air pressure of about 30–40 psi is preferred for driving the shot through the nozzle with sufficient momentum for selectively scrubbing the workpiece as described hereinbelow.

In the selective scrubbing processes described above in the referenced patent applications and issued patents, the abrasive pliant shot is discharged through an inclined tubular nozzle at a shallow angle of incidence with the workpiece surface while being substantially normal or perpendicular to the protruding edge being treated. In this way, the surface is protected from the pliant shot, while the abrasive attribute thereof is effective for deburring or radiusing, or both, the sharp protruding edges of the various apertures in the disk.

However, the exemplary rotor disk used in those previous applications has opposite flat sides permitting unobstructed access of the inclined nozzle with the many bolt holes and dovetail slots in the disk requiring treatment of the shifting edges thereof. In the exemplary rotor disk 10 illustrated in FIGS. 1 and 2, a center shaft 36 extends axially outwardly from the disk surface 18 at the center bore thereof.

A row of axial bolt holes 38 extend completely through the disk near the center shaft 36 inboard of the row of axial dovetail slots 12 formed in the perimeter of the disk. The edges 14 of the slots 12 are serpentine, whereas the edges 14 of the bolt holes are circular. In either case, it is desired to direct the pliant shot perpendicularly to the specific portion of each shifting edge for deburring or radiusing thereof during operation, yet at an acute inclination angle to the flat sides of the disk.

In this regard, these slots 12 and holes 38 are preferably partially filled with a plug or filler 40 which is slightly recessed or stepped below the adjoining disk surface to expose a comer at the corresponding edges thereof. The plug may be formed by molding a filler material in all of the disk slots and bolt holes as desired, and maintaining a recess below the disk surface. A suitable plug material is elastomeric, such as polyurethane rubber, which is readily moldable to the disk.

The plug 40 protects the inside of the individual slots and holes from abrasion by the abrasive shot, and directs the shot in lateral impingement against the edges, and further controls the final radius of the slot edges during the scrubbing process.

Since it is desired to treat the entire length of each edge of the slots and holes during the scrubbing process, the protruding shaft 36 interferes or obstructs the proper placement of the inclined straight-flow nozzle disclosed in the previous patent applications.

Accordingly, the nozzle 24 initially illustrated in FIG. 2 is configured in accordance with the present invention for discharging the pliant shot radially outwardly from its discharge end instead of solely axially outwardly therefrom.

In a method of using the nozzle 24 illustrated in FIG. 2, the nozzle itself is positioned substantially perpendicularly to the flat surface 18 of the workpiece for discharging the shot stream at a shallow angle of incidence relative to the surface and substantially normal or perpendicular to the shifting edge for selective abrasion thereof. The pliant shot is channeled in a stream through the nozzle in the carrier air 28 which helps protect from abrasion the parallel surface along which it flows. However, material, such as the edges, which protrude into the shot stream are readily abraded thereby.

The nozzle 24 is illustrated in more particularity in accordance with an exemplary embodiment in FIG. 3. The nozzle includes a straight tube 42 suitably joined to the end of the hose 32 by a conventional screw coupling for example. A flared deflector 44 extends coaxially outwardly from the tube for deflecting the stream of pliant shot radially outwardly therefrom toward the surface 18 of the workpiece.

The tube 42 is axially straight for discharging the abrasive shot axially straight therethrough, and includes an annular inlet 46 at the proximal end thereof joining the hose 32, and an annular outlet 48 at the axially opposite end from which the shot is discharged. A straight shaft or rod 50 extends coaxially from the tube outlet and has a distal end fixedly joined coaxially with the deflector 44 for supporting the deflector at a suitable spacing downstream or outwardly from the tube outlet 48.

The deflector 44 diverges radially outwardly from its supporting rod 50 to define an arcuate or concave flare 52 in its outer surface facing upstream toward the tube outlet 48 for deflecting the shot radially outwardly. The surface flare is generally conical and diverges or increases in diameter from its proximal end at the distal end of the rod to the rim of the deflector having its greatest outer diameter.

Preferably, the rim of the deflector 44 has a larger diameter than the diameter of the tube outlet 48 for blocking axially straight flow toward the workpiece, with the flare being configured for turning and deflecting the stream of shot from its initial axial discharge direction radially outwardly along the rim of the deflector.

Figure 4:
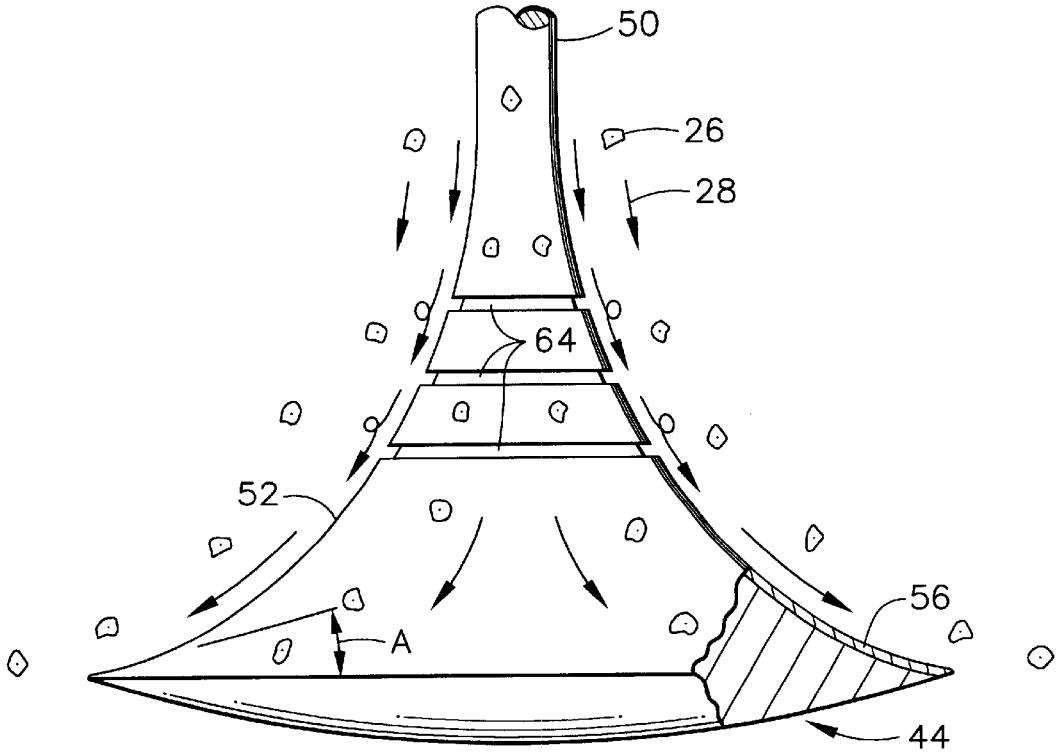
FIG. 4 is an enlarged, partly sectional elevational view of the nozzle deflector illustrated in FIG. 3 in accordance with a preferred embodiment.

FIG. 4 illustrates in more detail the preferred configuration of the flared deflector 44. In axial section, the flare 52 has an acute angle A relative to the radial axis of the deflector around the rim thereof for discharging the shot stream at a shallow or acute angle of incidence B to the flat workpiece surface 18 as illustrated in FIG. 3. In the preferred embodiment, both angles A,B are about 30 degrees for discharging the pliant shot laterally across the flat surface 18 with little if any abrasion thereof. However, protrusions into the shot stream are readily abraded by the abrasive attribute thereof.

Since the pliant shot is inherently abrasive, the nozzle is specifically configured for minimizing abrasive wear thereof during operation. For example, the rod 50 illustrated in FIG. 3 is straight and disposed coaxially along the longitudinal or centerline axis of the tube 42, and is cantilevered through the tube outlet without flow obstruction to the downstream deflector 44. In this way, the abrasive shot is discharged from the tube without obstruction and is then deflected radially outwardly by the downstream deflector.

Figure 5:
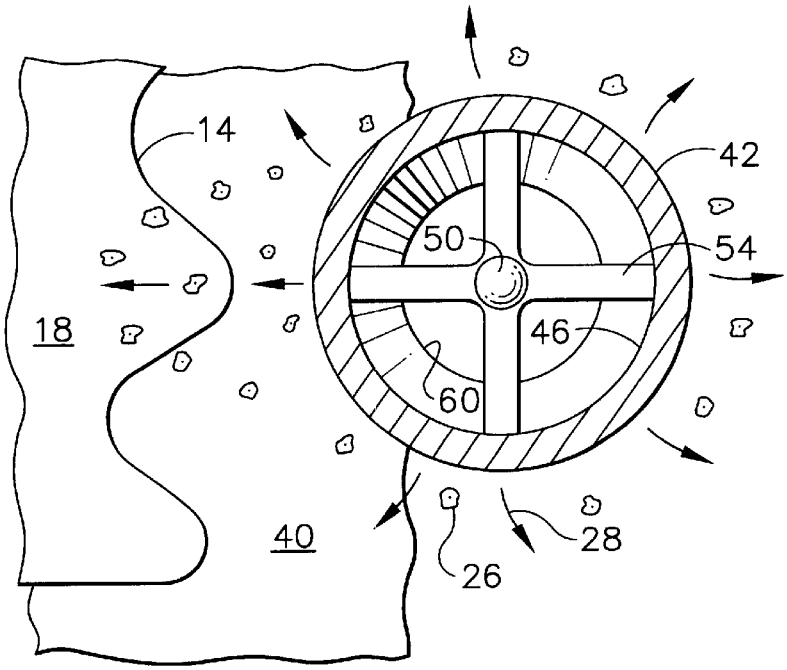
FIG. 5 is a horizontal sectional view through the nozzle illustrated in FIG. 3 and taken along the line 5—5 facing downwardly to the workpiece therebelow.

The rod 50 preferably extends coaxially through the tube to its inlet 46, and is fixedly mounted therein by several radially extending spokes or struts 54. Four exemplary struts 54 are illustrated in FIGS. 3 and 5 and extend diametrically inwardly from the inner surface of the tube at its inlet, and are fixedly joined to the proximal end of the rod 50 for cantilevering vertically downwardly through the nozzle tube 42.

The various components of the nozzle along which the abrasive shot is carried are preferably formed of a suitable material, such as hardened metal, and preferably have hardened flow surfaces for resisting wear abrasion thereof during use. For example, the inner surfaces of the tube 42 illustrated in FIG. 3, and the outer surfaces of the deflector 44 illustrated in FIG. 4, and the outer surfaces of the rod 50 and struts 54 illustrated in FIGS. 3 and 5 preferably have wear-resistant coatings 56 of a suitable material, such as hard Boride or Boron carbide, or resilient urethane.

As illustrated in FIG. 3, the nozzle tube 42 preferably includes a converging bore 58 extending from the tube inlet to a throat 60 of minimum flow area, followed in turn by a diverging bore 62 extending from the throat to the tube outlet. The supporting rod 50 extends coaxially through the tube bores with its distal end extending out the tube outlet 48 for supporting the deflector, and with its proximal end being fixedly mounted in the support struts 54.

In this way, the stream of abrasive shot in its carrier air is carried at relatively low velocity over the struts 54 and between the passages defined thereby for reducing abrasive wear of the struts during operation. The stream is then accelerated through the converging bore to the throat 60 and then diffused outwardly through the diverging bore 62. The pliant shot is transported by the carrier air along the arcuate flare 52 and redirected radially outwardly at the deflector rim.

As shown in FIG. 4, the carrier air 28 creates a boundary layer as it flows along the flare 52 to help protect the flare from abrasion from the shot. The concave curvature of the flare 52 is selected for smoothly transitioning the pliant shot from the initial axial direction as discharged from the tube outlet to a substantially radially outward direction at the deflector rim, with the shot flowing generally parallel to the curved surface of the flare for minimizing abrasion wear thereof.

In order to further protect the deflector from abrasion wear by the shot channeled thereover during operation, the flare 52 preferably includes a plurality of annular grooves 64 recessed into the smooth surface thereof for introducing turbulence into the carrier air stream during operation. Turbulence increases the effectiveness of the boundary layer air for protecting the deflector flare from abrasion by the shot during operation.

The grooves 64 are preferably disposed in the flare adjacent the distal end of the supporting rod 50 to initiate turbulence in the carrier air at the proximal end of the flare for protecting the flare over its entire curved surface. The number of grooves, width and depth thereof, and pitch spacing therebetween may be selected for maximizing their effectiveness to develop the protective boundary layer of air and minimize abrasion of the deflector during operation. Preferably, the pitch spacing of the grooves is greater than several widths of the individual grooves for maintaining most of the flare surface substantially continuous and smooth, with only local turbulator sites for maximizing boundary layer effectiveness.

As illustrated in magnification in FIG. 3, the pliant shot 26 is preferably in the form of a light-weight, resilient material such as sponge, rubber, felt, plastic, foam, or other resilient material. The shot may have open or closed cells. The shot preferably includes abrasive particles 26*a* imbedded therein, although in alternate embodiments abrasive may be omitted. Suitable abrasives include particles of various minerals, metal oxides, plastics, and black walnut shell, for example.

One type of suitable pliant shot is commercially available from Sponge-Jet Inc, of Eliot, Maine under the tradename of Sponge Media. This Sponge Media includes a polyurethane open-cell carrier in which is impregnated different types of abrasive material for different abrasive performance. And, one form of the Sponge Media is without abrasive.

The Sponge Media is conventionally blasted generally perpendicularly against a surface of a workpiece for removing coatings thereof while profiling the underlying surface for removing some of the material therefrom for enhancing re-coating in a subsequent process. Similarly, the pliant shot 26 is quite abrasive when blasted perpendicularly to a workpiece surface.

However, the exposed flat surfaces 18 of the rotor disk illustrated in FIG. 2, for example, are typically in finished form with a smooth surface finish. It is therefore desirable to minimize any change thereof during the shot scrubbing process and selectively apply the abrasive shot against the intended shifting edges 14 which require deburring or radiusing, or both.

As illustrated in FIGS. 3 and 5, the nozzle 24 is positioned substantially perpendicularly to the desired surface of the workpiece having the shifting edge 14 being treated. The shot discharged from the tube outlet 48 is redirected radially outwardly by the deflector 44 at the desired shallow angle of incidence B with the workpiece surface 18.

In this way, the shot is constrained by its carrier air to flow generally parallel with the workpiece surface with little, if any, abrasion thereof for protecting its surface finish. However, as shown in FIG. 5, some of the discharged shot 26 is directed substantially normal or perpendicular to a local portion of the shifting edge 14. In this way, the shot will impinge the edge 14 for removing protruding burrs, as well as radiusing the otherwise sharp comer as illustrated in FIG. 3. The depth of the filler plug 40 controls the radius of the resulting treated edge 14 during the scrubbing process.

A particular advantage of the nozzle illustrated in FIG. 2 is the omnidirectional discharge of the stream of shot 28 around the full 360 degree perimeter of the deflector during operation. Since there are multiple dovetail slots 12 and multiple bolt holes 38, the omnidirectional discharge nozzle 24 can simultaneously treat opposite edges thereof within the effective discharge path of the nozzle.

As shown in FIG. 2, the motor 22 may be operated for rotating the turntable 20 and in turn rotating the rotor disk 10 mounted thereon to position the corresponding edges 14 of the slots or holes sequentially below the perpendicularly oriented nozzle 24 which discharges the shot stream against the edges to selectively abrade material therefrom. The workpiece may be rotated at a relatively low speed of about 10 rpm for example to sequentially position the slots and holes in the discharge path of the nozzle for sequentially abrading the corresponding edges thereof.

In the preferred embodiment illustrated in FIG. 2, means in the conventional form of a translation carriage 66 are used to mount the nozzle 24 atop the workpiece and translate or move the nozzle radially inwardly and outwardly over the slots and holes as required for full edge treatment thereof. Since the nozzle may be translated up to the shaft 36, the entire circular edges of the row of bolt holes may be fully treated, as well as the entire serpentine edges of the row of dovetail slots.

The protruding disk shaft 36 does not obstruct or interfere with the required position of the perpendicularly mounted nozzle 24 since the pliant shot is discharged therefrom radially outwardly from the rim of the deflector 44. Inclination of the entire nozzle is not required, and, therefore, its lateral space requirement is substantially reduced.

The nozzle may be moved radially inwardly and outwardly across the slots and holes as the disk rotates during the scrubbing process so that the full rows of slots and holes are deburred and radiused as desired over their entire annular or shifting edges thereof.

Accordingly, all of the advantages of deburring or radiusing, or both of shifting edges of the rows of dovetail slots and bolt holes previously disclosed in the above identified patent applications are available in the present invention in a scrubbing process not limited by the protruding disk shaft 36. The shallow angle of incidence of the pliant shot atop the finished workpiece surface is readily obtained for protection thereof, while the pliant shot is directed substantially perpendicular to the protruding shifting edges which are readily abraded during the process.

The omnidirectional discharge of the pliant shot around the deflector rim substantially increases the effective coverage of the pliant shot on multiple edges of the apertures within the discharge stream as the disk is rotated during the process. In this way, a single discharge nozzle 24 may be used in combination with the rotating disk for selectively abrading all of the shifting edges of the rows of slots and holes in one operation.

Without the omnidirectional nozzle, several straight-flow nozzles of conventional design would be required at multiple locations and orientations to properly access the entire perimeters of the bolt holes and dovetail slots due to the obstruction of the protruding shaft. The single omnidirectional nozzle not only reduces the number of straight-flow nozzles required, but also eliminates the corresponding complexity of feeding multiple nozzles simultaneously with respective shot streams.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured Letters Patent of the United States is the invention as defined and differentiated in the following claims in which we claim:

1. An abrasive shot nozzle comprising a tube having an inlet and outlet disposed coaxially at opposite ends thereof, and a flared deflector extending coaxially from said outlet for deflecting radially outwardly therefrom a stream of abrasive pliant shot channeled axially straight through said tube from said inlet, and said tube and deflector have hardened flow surfaces for resisting abrasion thereof from said shot stream.

2. A nozzle according to claim 1 further comprising a support rod extending coaxially from said tube outlet and fixedly joined coaxially with said deflector for spacing said deflector outwardly from said outlet.

3. A nozzle according to claim 2 wherein said deflector diverges radially outwardly from said rod to define an arcuate flare facing said tube outlet for deflecting said shot radially outwardly.

4. A nozzle according to claim 3 wherein said deflector includes a rim being larger in diameter than said tube outlet.

5. A nozzle according to claim 4 wherein said flare has an acute angle around said rim relative to a radial axis of said deflector.

6. A nozzle according to claim 4 wherein said rod is cantilevered through said tube outlet without flow obstruction between said inlet and said deflector.

7. A nozzle according to claim 6 wherein said rod extends coaxially through said tube to said inlet thereof, and is fixedly mounted in said inlet by struts extending radially between said rod and tube.

8. A nozzle according to claim 7 wherein said tube includes a converging bore extending from said inlet to a throat, and a diverging bore extending from said throat to said outlet, and said rod extends coaxially therethrough.

9. A nozzle according to claim 4 wherein said deflector flare includes a plurality of annular grooves therein.

10. A nozzle according to claim 9 wherein said grooves are disposed in said flare adjacent said rod.

11. A method of using an abrasive shot nozzle including a tube and a flared deflector extending coaxially from an outlet thereof for deflecting a stream of abrasive pliant shot radially outwardly therefrom, comprising:

channeling said shot in a stream of carrier fluid through said nozzle; and positioning said nozzle substantially perpendicularly to a workpiece having a shifting edge adjoining a surface thereof to direct said shot stream at a shallow angle of incidence with said surface and substantially normal to said edge.

12. A method according to claim 11 further comprising rotating said workpiece to position a plurality of said edges sequentially below said nozzle for discharging said shot stream thereagainst to abrade material therefrom.

13. A method according to claim 12 wherein said workpiece includes a center shaft projecting outwardly from said surface, and a plurality of apertures positioned adjacent said shaft and including said shifting edges therearound, and said method further comprises moving said nozzle radially inwardly over said apertures up to said shaft as said workpiece rotates.

14. A method according to claim 13 wherein said pliant shot comprises a resilient sponge with imbedded abrasive particles therein.

15. A nozzle comprising:

A tube having an inlet and outlet at opposite ends thereof, a converging bore extending from said inlet to a throat, and a diverging bore extending from said throat to said outlet;

a support rod extending coaxially through said converging and diverging bores and out said outlet; and a flared conical deflector fixedly joined to a distal end of said rod outside said tube outlet for deflecting radially outwardly a stream of abrasive pliant shot discharged from said tube outlet.

16. A nozzle according to claim 15 wherein said deflector diverges radially outwardly from said rod to a rim thereof to define an arcuate flare facing said tube outlet, and said flare and tube bores are hardened for resisting abrasion thereof from said shot stream.

17. A nozzle according to claim 16 further comprising a plurality of struts extending radially inwardly from said tube at said inlet thereof, and fixedly joined to said rod for cantilevering said rod through said bores and outlet of said tube.

18. A nozzle according to claim 17 wherein said deflector flare includes a plurality of annular grooves therein.

19. An apparatus for treating edges of a plurality of circumferentially spaced apart apertures bordering a surface in a disk, comprising:

means for rotating said disk;

a nozzle including:

a tube having an inlet and outlet at opposite ends thereof, a converging bore extending from said inlet to a throat, and a diverging bore extending from said throat to said outlet;

a support rod extending coaxially through said converging and diverging bores and out said outlet; and a flared conical deflector fixedly joined to a distal end of said rod outside said tube outlet; and means for channeling a stream of abrasive pliant shot in a carrier fluid through said nozzle for discharge from said outlet thereof radially outwardly along said deflector.

* * * * *